United States Patent [19]

Baker

[11] 4,357,009

[45] Nov. 2, 1982

[54] WATER-FILLED WEIGHT BAG

[76] Inventor: Phillip L. Baker, 3133 W. 15th, Topeka, Kans. 66604

[21] Appl. No.: 160,654

[22] Filed: Jun. 18, 1980

[51] Int. Cl.[3] ..... A63B 21/12

[52] U.S. Cl. ..... 272/96; 272/DIG. 5; 272/119; 150/2.4; 128/402

[58] Field of Search ..... 272/119, 116, 117, 143, 272/DIG. 1, 96, 93, 70; 128/25 B, 80 R, 80 G, DIG. 20, 214R, 402, 403; 150/2.4

[56] References Cited

U.S. PATENT DOCUMENTS

| | | | |
|---|---|---|---|
| 2,749,914 | 6/1956 | Braley | 128/402 |
| 3,338,237 | 8/1967 | Sconce | 128/DIG. 20 |
| 3,628,537 | 12/1971 | Berndt | 150/2.4 |
| 4,109,907 | 8/1978 | Zito | 272/117 |
| 4,219,892 | 9/1980 | Rigdon | 128/DIG. 20 X |
| 4,223,695 | 9/1980 | Muetterties | 128/214 R X |

*Primary Examiner*—Richard C. Pinkham
*Assistant Examiner*—William R. Browne
*Attorney, Agent, or Firm*—Edward L. Brown, Jr.

[57] ABSTRACT

A water-filled weight exercise bag having two compartments, one surrounding the lower leg and the other surrounding the foot, with a lace for retaining the bag in place, located under the foot and along the back of the leg. The adjustable lace allows the bag to be filled with differing weights of water to accommodate the particular weight required. The two compartments are connected by a portion for fluid communication therebetween and which provide a hinge so that one of the compartments may be flexed out of the general plane of the other compartment.

10 Claims, 3 Drawing Figures

WATER-FILLED WEIGHT BAG

BACKGROUND OF THE INVENTION

The present invention relates to a device for exercising the quadriceps and hamstring muscles of the leg after surgery or recovering from an injury. In recent years, there has also been a substantial increase in the use of training weights on both legs and arms for the purpose of strengthening muscles and improving endurance and coordination in certain athletic programs.

The concept of an adjustable weight carried on the foot is well-known in the prior art as exemplified by the following patents:

U.S. Pat. No. 3,427,020 to Montour, et al

U.S. Pat. No. 3,406,968 to Mason

U.S. Pat. No. 3,334,898 to McCory, et al.

Normally some form of lead weight is removably positioned in an ankle-wrap device, however, the Montour, et al U.S. Pat. No. (3,427,020) does teach the utilization of any fluid material which can be carried in a series of small compartments removably positioned in pockets around the device.

DESCRIPTION OF THE PRESENT INVENTION

The present invention teaches a very simplified bag structure which can be filled with varying amounts of water to establish the proper weight from a single fill opening. The bag is formed in two compartments, both of which are connected which surround the front surface of the leg and the top surface of the foot in a somewhat saddle arrangement. Most of the other weight bags such as the three mentioned above, position the weights on the back of the ankle or under the bottom of the foot so that the laces transmit most of the weight to the foot and ankle which can be quite uncomfortable in situations where there is substantial weight in the bag. With the present invention, the bag compartments are located on the front of the leg and top of the foot so that the weight is widely distributed over the total contact area and there are no concentrated pressure points on the foot of the wearer such as would be true with a top-lace arrangement as described above. The laces on the present invention are located along the back of the leg and under surface of the foot, and merely maintain the position of the weight bag on the leg and foot. The lower compartment of the bag surrounding the foot also effectively prevents the bag from sliding down the leg of the user.

It is therefore the principal object of the present invention to provide an adjustable weight exercise bag for the foot and lower leg which is relatively inexpensive and simple in design.

Another object of the present invention is to provide an adjustable weight bag which utilizes water as a weight medium and can have a wide range of weight amounts.

A further object of the present invention is to provide a water-filled weight bag for the lower leg and foot which also functions as an ice bag capable of surrounding the lower leg and foot.

A further object of the present invention is to provide an adjustable weight bag having the instructions for use and weight markings printed on the front thereof.

Other objects and advantages of the present invention will become more readily apparent from the examination of the following specification taken in conjunction with the accompanying drawings and claims wherein:

DESCRIPTION OF THE PREFERRED EMBODIMENT

Figure 1:
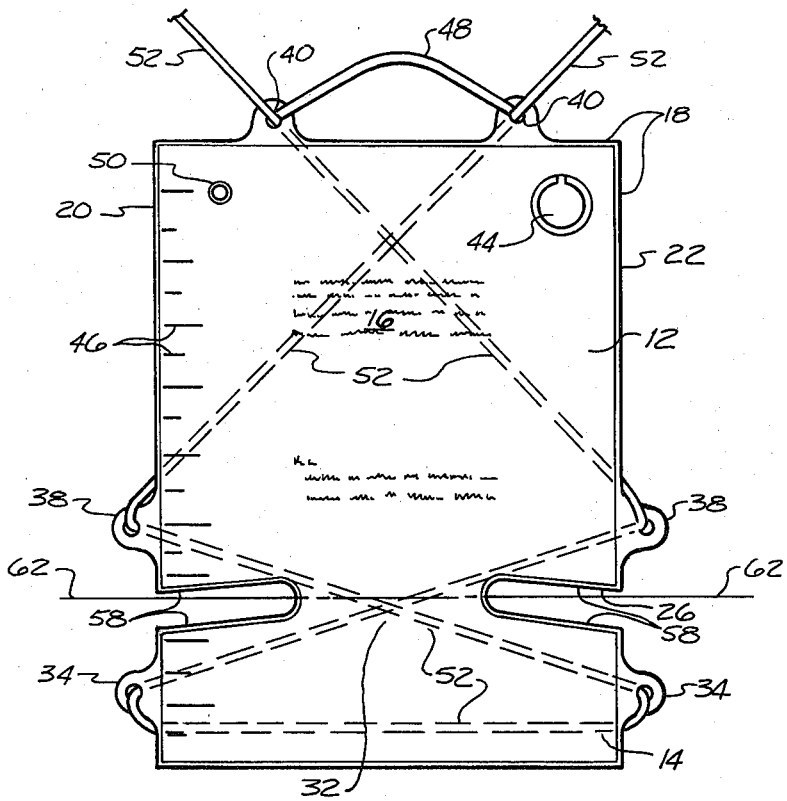
FIG. 1 is a plan view of the bag laid out on a planar surface.

Referring now particularly to FIG. 1 of the drawing, the weight bag is generally identified by reference numeral 10 and includes a first larger compartment 12 connected to a second smaller compartment 14. The bag is constructed of two thin sheets of translucent flexible plastic material 16 which are sealed around their periphery by a heat seam 18, which is a conventional well-known technique. The sheet material 16 can be any flexible waterproof material such as polyethylene, for example. Connecting the first compartment with the second compartment 14 is a portion 32 which is open internally, allowing water to flow between the compartments 12 and 14. The bag 10 is filled through a closeable opening 44 which is also formed of soft plastic and molded to the sheet material 16 by conventional heat sealing techniques mentioned above. Located at the left corner of compartment 12 is an air purge valve 50 which is also molded to sheet material 16 and is a common type purge valve similar to those used in air mattresses and other inflatable devices.

Figure 2:
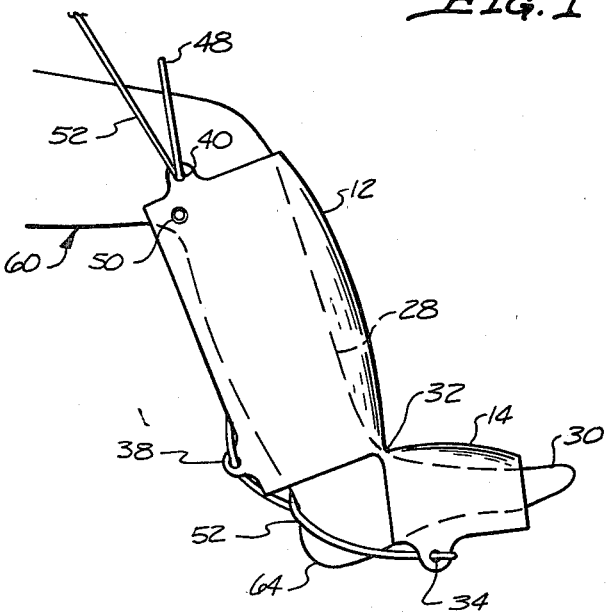
FIG. 2 is a side elevational view of the bag filled with water and in place on the user's leg in a knee-bent position.

The upper compartment 12 of the bag includes sides 20 and 22, and top and bottom 24 and 26, respectively. Attached to the sides of the bag 10 are a plurality of eyelets 38 and 34 which are also molded integrally with sheet material 16. Located along the top edge 24 of the bag is another pair of eyelets 40. Laced through eyelets 34, 38 and 40, respectively, is a single lace 52 which crisscrosses from bottom to top and comprises the tying means for attaching the bag to the user's leg. Also attached to eyelets 40 is a handle 48 for supporting or lifting the bag either on or off the leg 60 of the user. Located along the left edge of the bag, as seen in FIG. 1, are a plurality of weight gradation marks of the bag as it is filled with water from a vertical hanging position. The second compartment 14 is defined separately from compartment 12 by a pair of cut-out slots 58 which allow the two compartments to be pivoted about an axis 62 which lies along the connecting width portion 32 of the bag so as to permit the two compartments to pivot relative to each other when they are wrapped around respective portions of the leg 28 and foot 30, as seen in FIG. 2. Printed on the front of the surface of bag 10 are operating instructions 54 which instruct the patient or user of the general techniques in filling and using the exercise bag.

METHOD OF USE OF THE BAG

The bag is initially hung from a stationary point by handle 48 while the bag 10 is filled with water through closeable opening 44. As the water level rises in the bag, the weight of the water can be read at gradation marks 46 along the left edge of the bag. This, of course, assumes that the bag is hanging on a true vertical axis. After the particular weight level for the exercise is reached, the opening 44 is closed by its self-attached cap which is a well-known plastic design utilized in the art and therefore not shown in detail. The air remaining in the top of the bag 10 is purged by the opening of valve 50 while compressing the sides of the bag until all of the air is exhausted.

Figure 3:
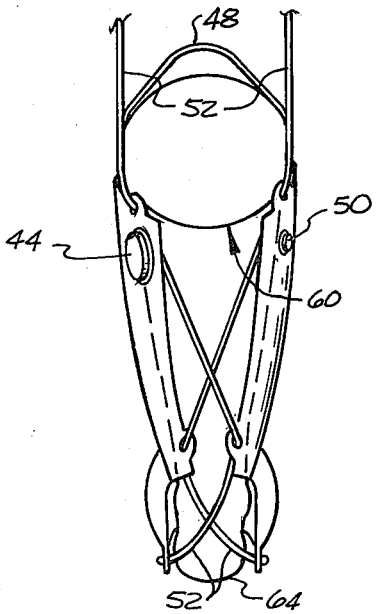
FIG. 3 is a rear elevational view of the bag in place on the leg.

With the lace 52 loosely in place, as seen in FIG. 1, the bag 10 is placed over the leg of the user with the lace 52 under the leg 60. As the lace 52 is drawn tight, the compartments 12 and 14 are wrapped around the lower leg 28 and foot 30 in a saddle-like manner until they are held relatively snug, as seen in FIGS. 2 and 3. Due to the hinging action of connecting portion 32 of the bag, the second compartment 14 is allowed to pivot and conform to the contour of foot 30 of the user. The bag 10 is prevented from sliding down the leg 60 by the lace 52 which crisscrosses behind the heel 64 of the user, preventing compartment 14 from sliding off the foot 30. The upper ends of the lace 52, not shown in the drawing, can either be held manually by the person doing the exercise or tied together in any manner desired. Quite often when performing beginning exercises after an injury or surgery, it is helpful for the user to assist the extension of the leg by lifting on handle 48.

As the weight level is increased, the bag 10 will increase in thickness. However, the adjustable lace 52 permits the thicker compartments to be held in place on the leg.

The bag 10 has a secondary function in that when filled with ice through opening 44, it can be used as an ice bag for injuries to the ankle and lower leg which can be held accurately in place by lace 52.

From the foregoing description together with the accompanying drawing, it will be readily apparent to those skilled in the art that this invention provides a significant advance in the art of exercise weight bags, and that neither the fastening means or the compartments of the bag will create discomfort or concentrated pressure points to the foot of the user. The following claims should provide the sole measure of the scope of the invention.

What is claimed is:

1. A fluid-filled weight bag carried around the front of the lower leg and one foot of the user for therapeutic exercise comprising:

two layers of waterproof flexible material peripherally secured together, defining a first substantially rectangular compartment with sides, a top and a bottom adapted to be wrapped around the lower leg; and a second compartment of comparable width, means connecting the bottom of said first compartment to said second compartment for communicating the interiors of said compartments for fluid flow therebetween and providing a hinge portion to permit the second compartment to flex out of the general plane of the first compartment, tie means secured to the sides of the first and second compartments for wrapping and securing said compartments about the lower leg and foot respectively; and closeable opening means in the bag for filling and draining said compartments to adjust the weight carried in the exercise bag.

2. An exercise weight bag as set forth in claim 1, including weight gradations along the sides of said compartments to indicate the amount of weight carried in said bag.

3. An exercise weight bag as set forth in claim 1, including weight gradations along the sides of said compartments to indicate the amount of weight carried in said bag, and handle means connected to the top of the first compartment to lift and support the bag while filling and before mounting on the leg of the user.

4. An exercise weight bag as set forth in claim 1, including weight gradations along the sides of said compartments to indicate the amount of weight carried in said bag, and handle means connected to the top of the first compartment including eyelets molded in the periphery of the flexible material.

5. An exercise weight bag as set forth in claim 1, including weight gradations along the sides of said compartments to indicate the amount of weight carried in said bag, and handle means connected to the top of the first compartment to lift and support the bag while filling and before mounting on the leg of the user, and purge valve means located approximate the top of the first compartment for removing air from the water-filled compartments.

6. An exercise weight bag as set forth in claim 1, wherein the means includes a plurality of eyelets molded along the sides of each compartment, and an adjustable lace across the back of the bag which crosses back and forth from side-to-side from bottom to the top of the bag to retain both compartments of the bag in place with varying amounts of water in the bag.

7. An exercise weight bag as set forth in claim 1, including weight gradations along the sides of said compartments to indicate the amount of weight carried in said bag, and instructions printed on the bag for the particular exercise for which the bag is to be used.

8. An exercise weight bag as set forth in claim 1, wherein the connecting portion of the bag between the first and second compartments is positioned approximately at the center width of the bag, defining two cut-out slots between the compartments extending inwardly from the sides of the compartments a substantial distance.

9. An exercise weight bag as set forth in claim 1, wherein the connecting portion of the bag between the first and second compartments is positioned approximately at the center width of the bag defining two cut-out slots between the compartments extending inwardly from the sides of the compartments a substantial distance, and the slots have an upward slope toward the first compartment.

10. An exercise weight bag as set forth in claim 1 including weight gradation means of unequal vertical spacing due to the varying horizontal cross section of a fluid-filled bag.

* * * * *